US005189950A

United States Patent [19]

Eppinger

[11] Patent Number: 5,189,950

[45] Date of Patent: Mar. 2, 1993

[54] SCREEN PRINTING MACHINE AND PRINT HEAD CARRIAGE THEREFOR

[75] Inventor: Otto R. Eppinger, Parkdale, Australia

[73] Assignee: Reefdale Pty. Ltd., Braeside, Australia

[21] Appl. No.: 769,427

[22] Filed: Oct. 1, 1991

[30] Foreign Application Priority Data

Oct. 1, 1990 [AU] Australia ..... PK2581/90
Mar. 7, 1991 [AU] Australia ..... PK4949/91

[51] Int. Cl.[5] ..... B41F 15/10
[52] U.S. Cl. ..... 101/115; 101/123
[58] Field of Search ..... 101/115, 123, 126

[56] References Cited

U.S. PATENT DOCUMENTS 4,934,263 6/1990 Eppinger ..... 101/115
4,962,702 10/1990 Eppinger ..... 101/114
4,974,507 12/1990 Eppinger ..... 101/115
5,031,527 7/1991 Eppinger ..... 101/115

FOREIGN PATENT DOCUMENTS 8901865 3/1989 PCT Int'l Appl. ..... 101/115

*Primary Examiner*—Clifford D. Crowder
*Attorney, Agent, or Firm*—Jacobson, Price, Holman & Stern

[57] ABSTRACT

Screen printing machines of the carousel type and apparatus for use in those machines. One of the features relates to a print head assembly having a carriage mounted for reciprocating movement, the carriage comprising two spaced apart bearing sections arranged relative to three support members. Another feature relates to an improved air manifold for the print head assembly. Yet another feature is concerned with an improved screen holding device utilizing inflatable bags. Yet another feature relates to an improved vacuum supply mechanism. A further feature is concerned with an improved frame structure.

15 Claims, 11 Drawing Sheets

56
56
56
212
212
214
214

20
18
202
206
208
200
204
204
211
210
202
30
207

184
180
182
194
188
190
20
196
198
186
188
190
192
18
188
30

SCREEN PRINTING MACHINE AND PRINT HEAD CARRIAGE THEREFOR

This invention relates generally to screen printing machines and apparatus for use in such screen printing machines.

There are several inventive aspects to the present invention which may be conveniently and advantageously used in combination although in certain applications may not all be used in combination. The various aspects of the present invention all are suitable for use in screen printing machines of the carousel type although it will be appreciated that some features forming some aspects of the invention will find application in other types of screen printing machines and apparatus. It will be convenient to describe the various aspects of the invention with reference to screen printing machines of the carousel type but this is not to be taken as a limitation as to the scope of the present invention.

Screen printing machines of the carousel type may comprise a multiple armed fixed frame and a complementary multiple armed frame which is mounted for rotation relative to the fixed frame. The machine further includes a plurality of print heads and screen platens one group being operatively connected to respective movable arms and the other group being operatively connected to respective fixed arms. Each print head assembly comprises a movable carriage which is mounted for reciprocating movement relative to the arm upon which it is mounted, the carriage having suitable print heads and/or other application devices thereon.

One previously proposed means for driving each carriage comprises a piston/cylinder assembly which is mounted to a respective arm of the frame and is arranged with the piston rod being connected more or less directly to the carriage with the carriage being located beyond the piston rod at the outer end of the arm.

A major disadvantage of this arrangement is that in many instances long arms are required to mount the piston/cylinder assembly in line with the carriage.

This particular in-line arrangement can also lead to a general lack of stability in the mounting of the cylinder to the arm. Furthermore, access to the cylinder for the purpose of adjustment can be difficult because it is spaced so far from the free end of the frame arm.

It is an object of the present invention in one aspect to provide an improved print head assembly which alleviates one or more of the aforementioned problems.

Another object of the present invention is to provide an improved screen holding device.

Another object of the present invention is to provide an improved screen printing machine.

Another object of the present invention is to provide an improved frame assembly for a screen printing machine.

According to one aspect of the present invention there is provided a print head assembly for use with a screen printing machine of the type including a fixed frame having a plurality of arms and a movable frame carrying a plurality of platens, the movable frame being mounted for rotation relative to the fixed frame, the print head assembly comprising a mounting frame which in use is operatively connected to an arm of the fixed frame; a carriage operatively connected to the mounting frame and arranged for reciprocating movement relative thereto; a piston/cylinder assembly for causing the reciprocating movement of the carriage the assembly including a cylinder having opposed ends with a piston therein; first, second and third support members extending from the mounting frame and in spaced relation relative to one another, said third support member being disposed between said first and second support members; guide means operatively connected to said support members in spaced relation from the mounting frame such that together they form a rigid structure; said carriage including at least two bearing sections slidably received on said guide means said bearing sections being spaced apart with one being disposed between the first and third support members and the other between the second and third support members, and a coupling section operatively connecting the piston to the carriage, said cylinder being supported between one of said first or second support members and said third support member.

The guide means may comprise a pair of guide members which extend generally parallel to one another between said first and second support members. The piston/cylinder assembly includes a piston rod operatively connected to the piston and extending from one end of the cylinder said coupling section being operatively connected at or towards a free end section of the piston rod.

The guide members may comprise a pair of elongated guide rods arranged generally parallel to one another and in spaced apart relation with the piston rod therebetween. The guide rods may be disposed one above the other in a general vertical plane.

In one form, the support members may comprise first and second support plates operatively connected to and extending laterally from the mounting frame with said guide members having the ends thereof operatively connected to respective ones of said first and second plates so as to extend therebetween. The support members may further include a third support plate operatively connected to and extending from the mounting frame at a position intermediate the first and second support plates, the cylinder of the piston/cylinder assembly being supported between the third support plate and one of the first or second support plates.

The assembly may further include a fixing frame which is adapted to be secured to an arm of the machine the fixing frame being adapted to receive the mounting frame thereon and being releasable to allow the mounting frame to be movable along the arm.

Preferably the carriage is adapted to have a print head mounted thereto. The mounting frame may be adapted to house delivery lines for the print head on the carriage.

The invention also provides a screen printing machine including a fixed frame and a movable frame, the machine including at least one print head assembly connected to one of the arms of the fixed frame.

Preferably there is also provided an adjustment system which enables adjustment of the length of the stroke of the carriage. The system comprising at least one actuation member having a longitudinal axis which extends generally parallel to the direction of travel of the carriage and a pair of abutment blocks adapted to be slidably supported on the or each elongated guide member and the actuation member so that the abutment blocks can adopt selected positions along the length thereof, the abutment blocks being disposed relative to the carriage so that they can be engaged by the carriage during its reciprocating movement. Control means may be provided which is associated with the actuation member and is responsive to engagement of the carriage with an abutment block. The arrangement is such that when the carriage engages an abutment block the control means causes the piston/cylinder to change its reciprocating direction.

Preferably the actuation member is mounted for limited movement in the direction of its longitudinal axis so that upon engagement of an abutment block by the coupling plate of the carriage the actuation member is shifted slightly in the axial direction, this axial movement causing actuation of the control means and deceleration of the carriage.

Preferably the control means comprises a control switch operable to activate control valves for the piston/cylinder assembly. The control switch may be arranged to be operable by engagement with a portion of the actuation member or a member operatively connected to the actuation member. For example, the switch may be engageable by a triggering shoulder formed on the actuation member.

Preferably the position of the abutment blocks is adjustable along the length of the actuation member and may include a locking means for releasably locking the abutment blocks to the actuation member.

According to another aspect of the present invention there is provided an air manifold adapted for use with a screen printing machine of the type including a fixed frame having a plurality of arms and a movable frame carrying a plurality of platens, the print head assembly comprising: a mounting frame which is, in use, operatively connected to an arm of the fixed frame, a pneumatic piston/cylinder assembly for reciprocating a print head assembly, said air manifold assembly comprising at least two superimposed manifold plates, the manifold plates being adapted to enable pressurised air to flow from a first portion of the air manifold to, and return from, at least a second portion remote from the first portion of the air manifold. The two parts of the manifold assembly may be bolted together although they could be moulded or cast and secured together by an adhesive or weld. Furthermore, the two parts can be formed from a variety of materials such as metal or plastics.

Preferably pneumatic hardware such as valves, air cylinders and piping may be connected to the air manifold assembly.

Preferably the air manifold assembly is adapted to be mounted to the print head assembly.

Preferably the air manifold assembly is adapted to be mounted beneath the print head assembly.

A print head assembly for mounting in a screen printing machine, the assembly including a support member which is, in use, reciprocated during a printing stroke of the machine, said assembly including a squeegee and a flood bar, and control means for alternatively raising and lowering the squeegee and/or flood bar.

Preferably the control means is mounted beneath an air manifold mounted to the print head assembly.

Preferably the control means is mounted in a substantially vertical orientation.

Preferably the squeegee and flood bar extend at right angles to the longitudinal axis of the print head assembly and include fixing means for releasably fixing the squeegee and/or flood bar to the control means.

Preferably a height adjustment means is provided to vary the position of the squeegee and/or flood bar in relation to the print head assembly. In one form, the height adjustment means may comprise a support member, extending parallel to the squeegee or flood bar, fixed to at least one generally upright member having a substantially vertical elongated slot therein, means for releasably fixing the upright member to the control means, the control means being adapted to mount the upright member whereby a height adjusting screw, in use, releasably fixes the upright member to the control means.

Preferably an angular adjustment means is provided to vary the angular orientation of the squeegee and/or flood bar in relation to the print head assembly, the angular adjustment means comprising an angle adjustment link pivotally connected at a first end portion to an end face of the support member and pivotally connected at a second end portion to a support clamp, the support clamp being adapted to releasably mount the support member to the angular adjustment link.

Preferably the support clamp comprises a pair of opposing jaws which pivot on the second end portion of the angle adjustment link and a locking screw thereby releasably mounting the squeegee and/or flood bar to the support member.

In another form of the invention, the height adjustment means may be at least in part comprised by part of the control means for alternately raising and lowering the squeegee and/or flood bar. In this particular arrangement, the control means may comprise a plurality of pneumatically operable cylinder assemblies each comprising a cylinder having a piston therein and a piston rod operatively interconnecting the squeegee and/or flood bar with the piston. According to this form of the present invention, the piston rod is rotatable and operatively connected to the squeegee and/or flood bar so that rotation thereof causes an actual adjustment between the piston rod and squeegee and/or flood bar. For example, the end of the piston rod operatively connected to the squeegee and/or flood bar may include a threaded section which co-operates with a threaded section on the squeegee and/or flood bar or mounting therefor and is arranged so that upon rotation of the two parts relative to one another an adjustment in the direction of the axis of the piston rod can be made.

In one advantageous form, the piston rod is adapted to extend through the cylinder having portions thereof projecting from each end. One end is preferably operatively connected to the squeegee and/or flood bar or a support therefor and the other end has an actuator such as, for example, a manually operable knob thereon for rotating the piston rod. The piston rod is operatively connected to the squeegee and/or flood bar preferably via a support bracket to which the squeegee and/or flood bar is mounted. The support bracket may include an elongated laterally extending arm having support flanges thereon adapted to receive a mounting element which can form part of the squeegee and/or flood bar. A clamping member such as a screw threaded rod may be adapted to releasably hold the mounting element in position on the support flange. Means may also be provided for locking the piston rod so as to inhibit rotation thereof. Such locking means may be in the form of a pin which is engageable with the threaded section of the screw threaded portion of the piston rod. Consequently the piston is disposed within a block mounted to the arm the block having a threaded hole for receiving the threaded portion of the piston rod.

The squeegee and/or flood bar may also be adapted for pivotable movement relative to its support so that it can be inclined at an angle relative to the platen.

To this end, each of the mounting elements may include a pivot pin about which the squeegee and/or flood bar can pivot. The pivot pin may further include means for tightening and retaining the squeegee and/or flood bar in a selected position.

Suitable thrust bearings may be provided at each end of the cylinder for providing support for the piston and piston rod assembly.

A further aspect of the present invention relates to the means for mounting the screen relative to the frame of the machine. Currently, the means provided comprises a pair of holding channels for receiving a respective side wall section of the screen. Pneumatically operated cylinder assemblies each having a clamping foot connected thereto are provided which can be brought into abutment against the screen so as to retain it with the holding channel.

According to this aspect of the present invention, the screen holding means includes an inflatable envelope or bag which is adapted to be disposed against the screen and the holding channel so that when it is inflated, it assists in inhibiting removal of the screen from the channel. In order to ensure that there is no pressure loss during operation, the incoming air supply has a check valve provided which inhibits the return of air from the inflatable envelope. The envelope may take any suitable shape or form. The plate may be mounted to the channel by adjustment screws or the like. The envelope may bear directly against an arm of the channel or, if desired, there may be provided a plate member which is mounted to the arm of the channel so as to be adjustable relative thereto so as to increase or reduce the depth of the channel; that is the space which receives the envelope can be adjusted to cater for different sized screens.

According to a further aspect of the present invention there is provided a screen printing machine having a plurality of fixed arms extending from a support member, the arms having print heads coupled thereto, a plurality of movable arms carrying platens, the movable arms being mounted for rotation relative to the support member and control means to adjust the positioning of the inner ends of the fixed arms to thereby enable correct alignment, in use, of the printing heads and the platens.

Preferably the control means comprises a level adjustment member which is fixedly mounted at a first end portion to the fixed arms and releasably fixed at a second end portion to the support member, the control means being mounted on the support member and being adapted to threadedly receive a level adjustment screw whereby the fixed arm may be moved laterally in relation to the support member.

According to another aspect of the present invention there is provided a screen printing machine having a plurality of fixed arms extending from a support member, the arms having printing heads coupled thereto, a plurality of movable arms carrying platens, the movable arms being mounted for rotation relative to the support member, said platens including suction means for holding the article to be printed thereon, vacuum supply means within said support member for supplying vacuum to said vacuum means, said vacuum supply means comprising a rotary manifold adapted to be mounted to a central column of the screen printing machine whereby vacuum may be ducted to the arms of the screen printing machine.

Preferably the vacuum supply means is formed as an upright elongate annular cylinder surrounding a central column of the screen printing machine, the open ends of the annular cylinder being enclosed and sealingly engaged by a top disc and a bottom disc, the top disc and the bottom disc being fixedly mounted to the central column.

Preferably the vacuum supply means is free to rotate relative to the central column.

Preferably blocking means is provided to shut off the vacuum supply means at a particular portion of the angular rotation of the arms of the machine.

According to a further aspect of the present invention there is provided a screen printing machine having a plurality of fixed arms extending from a support member, the arms having printing heads coupled thereto, a plurality of movable arms carrying platens, the movable arms being mounted for rotation relative to the support member, said platens including suction means for holding the article to be printed thereon, vacuum supply means within said support member for supplying vacuum to said vacuum means, said vacuum supply means comprising a rotary manifold adapted to be mounted to a central column of the screen printing machine whereby vacuum may be ducted to the arms of the screen printing machine.

Preferably the vacuum supply means is formed as an annular collar surrounding a central column of the screen printing machine, the annular collar being mounted to a disk which is fixedly mounted to the central column of the machine, the annular collar being sealingly engaged to the disk.

Preferably the vacuum supply means is free to rotate relative to the central column.

Preferably the vacuum supply means is mounted on or underneath the or each disk.

Preferably blocking means is provided to shut off the vacuum supply means at a particular portion of the angular rotation of the arms of the machine.

According to a further aspect of the present invention there is provided a screen printing machine having a plurality of fixed arms extending from a support member, the arms having printing heads coupled thereto, a plurality of movable arms carrying platens, the movable arms being mounted for rotation relative to the support member, pneumatic rams for reciprocating the print heads, sensing means for sensing pressure in or at the pneumatic rams and means coupled to said sensing means for preventing or initiating subsequent operations of the machine.

According to another aspect of the invention there is provided a frame assembly for a screen printing machine the assembly comprising a fixed frame which includes a central part with a plurality of fixed arms extending therefrom in generally radial fashion; a movable frame which includes a central part with a plurality of movable arms extending therefrom in generally radial fashion; each of the fixed arms being adapted for supporting a print head and each of the movable arms being adapted for supporting a platen; the improvement comprising wherein one or more of the movable arms comprises an inner section and an outer section which are securable together so that the longitudinal axes of the inner and outer sections are co-axial or generally parallel to one another, and one end portion of the inner section is operatively connected to the central part of the movable frame: an adjustable support strut assembly comprising a primary strut extending from the central part of the movable frame to a first region of the arm adjacent the outer end portion of the inner section and the inner end portion of the outer section and a secondary strut extending from the central part of the movable frame to a second region between the first region and the outer end of the arm, each strut being adjustable in length such that the orientation of the arm relative to the central pad can be adjusted.

Preferably the primary strut and the secondary strut each form a triangle in conjunction with the central part of the movable frame and the part and the point of connection of the strut to the arm, the strut in each case forming the hypotenuse of the triangle with which it is associated.

The outer end portion of inner arm section and the inner end portion of the outer arm section may be connected together with one overlying the other there being further provided adjustable screws interconnecting the sections so as to enable relative movement between them about an axis generally parallel to the longitudinal axis of the arm sections.

According to another aspect of the present invention there is provided a frame assembly for a screen printing including the assembly comprising a fixed frame which includes a central part with a plurality of fixed arms extending therefrom in generally radial fashion; a movable frame which includes a central part with a plurality of movable arms extending therefrom in generally radial fashion; each of the fixed arms being adapted for supporting a print head and each of the movable arms being adapted for supporting a platen; the improvement comprising wherein one or more of the movable arms comprises an inner section and an outer section which are securable together so that the longitudinal axis of the inner and outer sections are co-axial or generally parallel to one another, and one end portion of the inner section is operatively connected to the central part of the movable frame; wherein the inner section and outer section of the or each arm are interconnected by adjustment screws spaced laterally with respect to the longitudinal axis of the arm sections so that the arm sections can be moved relative to one another.

According to another aspect of the invention there is provided a frame assembly for a screen printing machine the assembly comprising a fixed frame which includes a central part with a plurality of fixed arms extending therefrom in generally radial fashion; a movable frame which includes a central part with a plurality of movable arms extending therefrom in generally radial fashion; each of the fixed arms being adapted for supporting a print head and each of the movable arms being adapted for supporting a platen; the improvement comprising an adjustable support strut assembly comprising a primary strut extending from the central part of the movable frame to a first region of the arm and a secondary strut extending from the central part of the movable frame to a second region of the arm between the first region and the outer end of the arm, each strut being adjustable in length such that the orientation of the arm relative to the central pad can be adjusted.

Preferably the primary strut and the secondary strut each form a triangle in conjunction with the central part of the movable frame and the part and the point of connection of the strut to the arm, the strut in each case forming the hypotenuse of the triangle with which it is associated.

Preferred embodiments of the invention will hereinafter be described with reference to the accompanying drawings in which.

Figure 1:
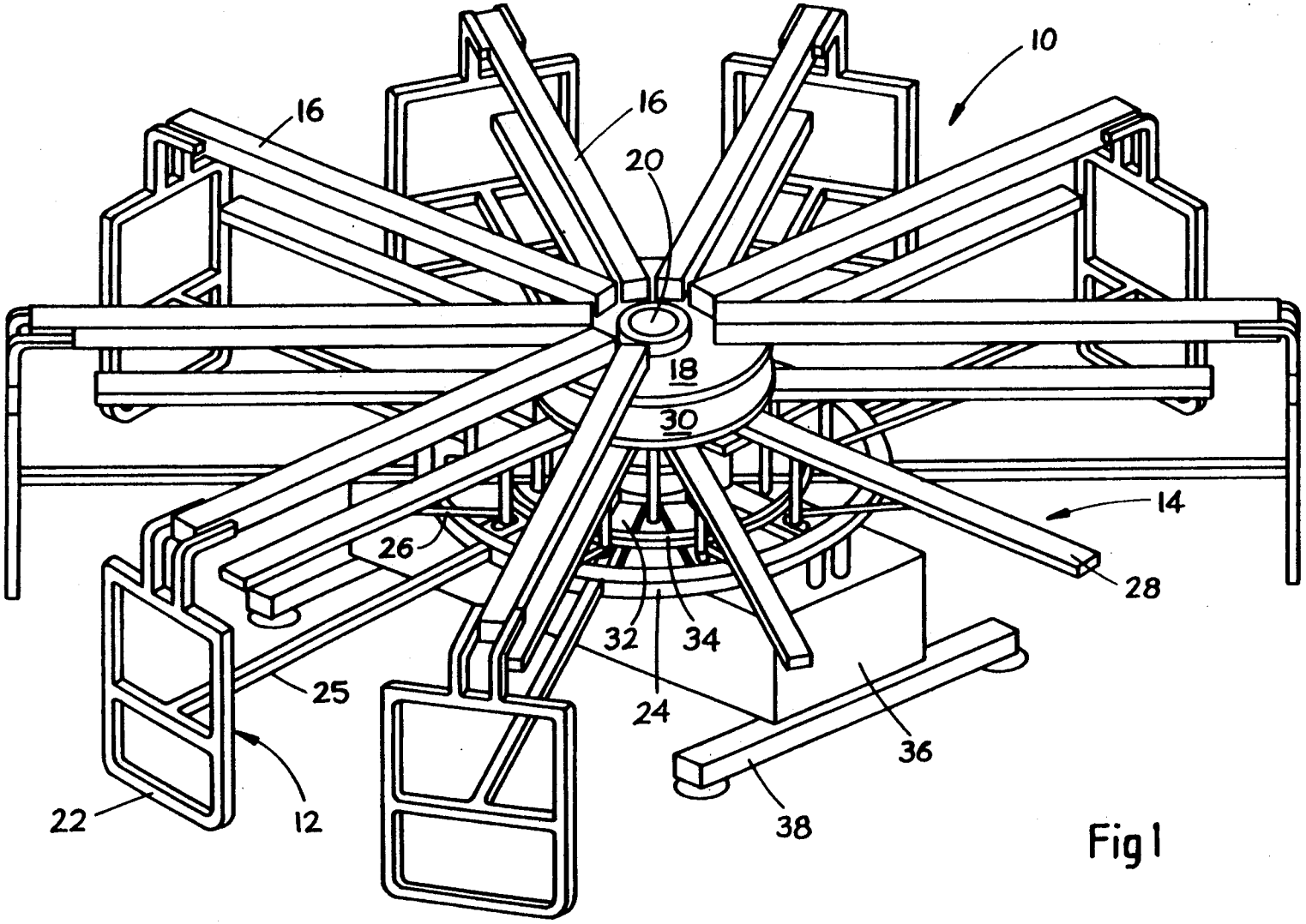
FIG. 1 is a perspective view of the principle frame elements of a screen printing machine.
Figure 2:
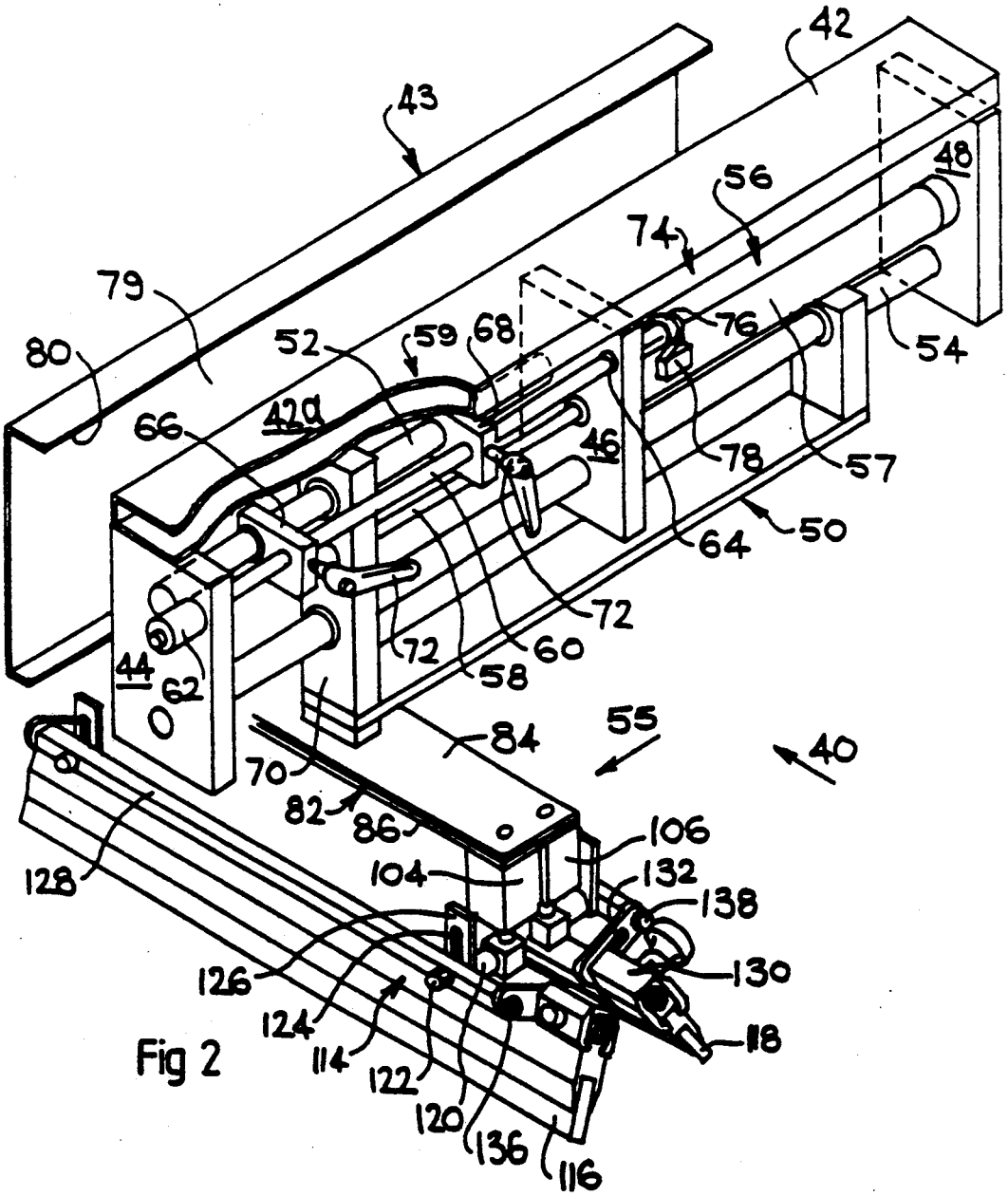
FIG. 2 is a perspective view of a print head assembly according to the invention.
Figure 4:
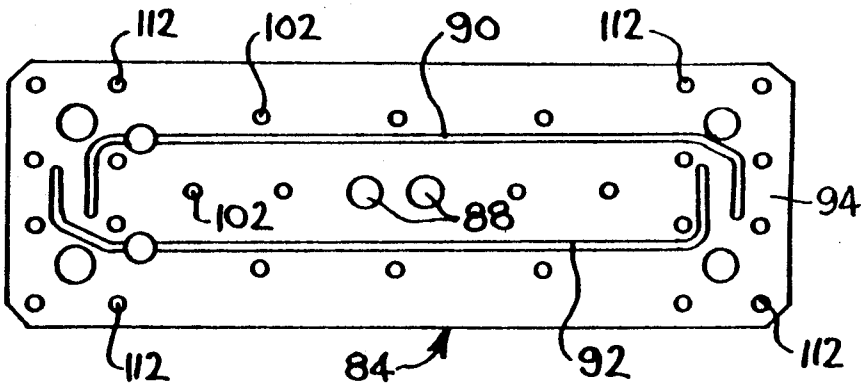
Figure 5:
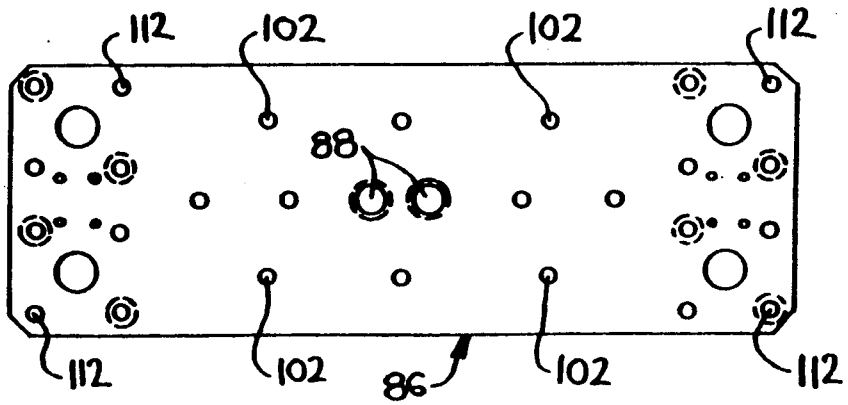
Figure 3:
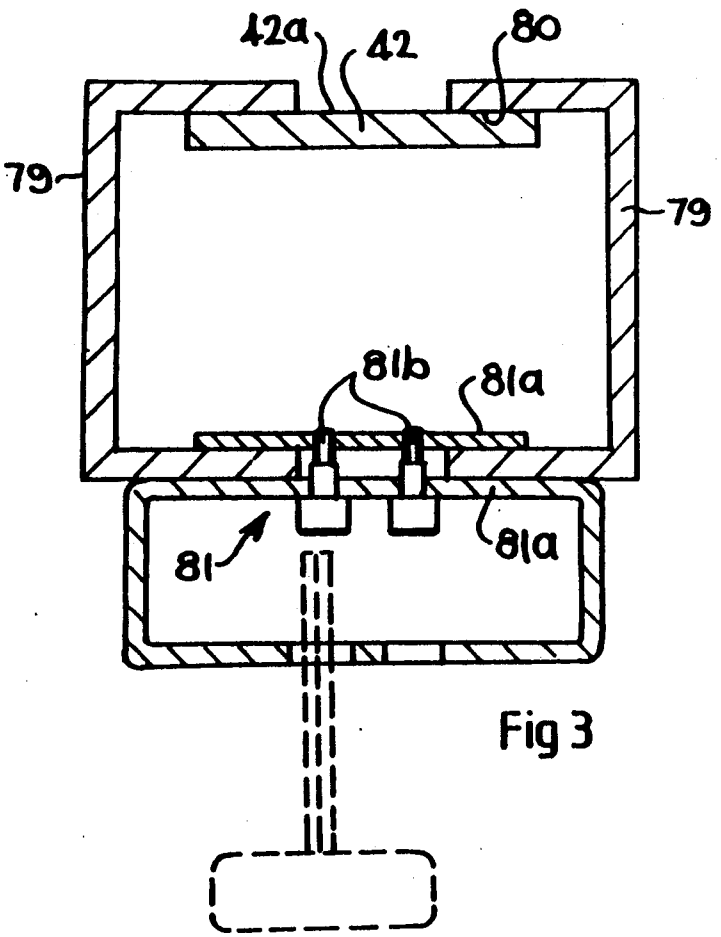
Figure 7:
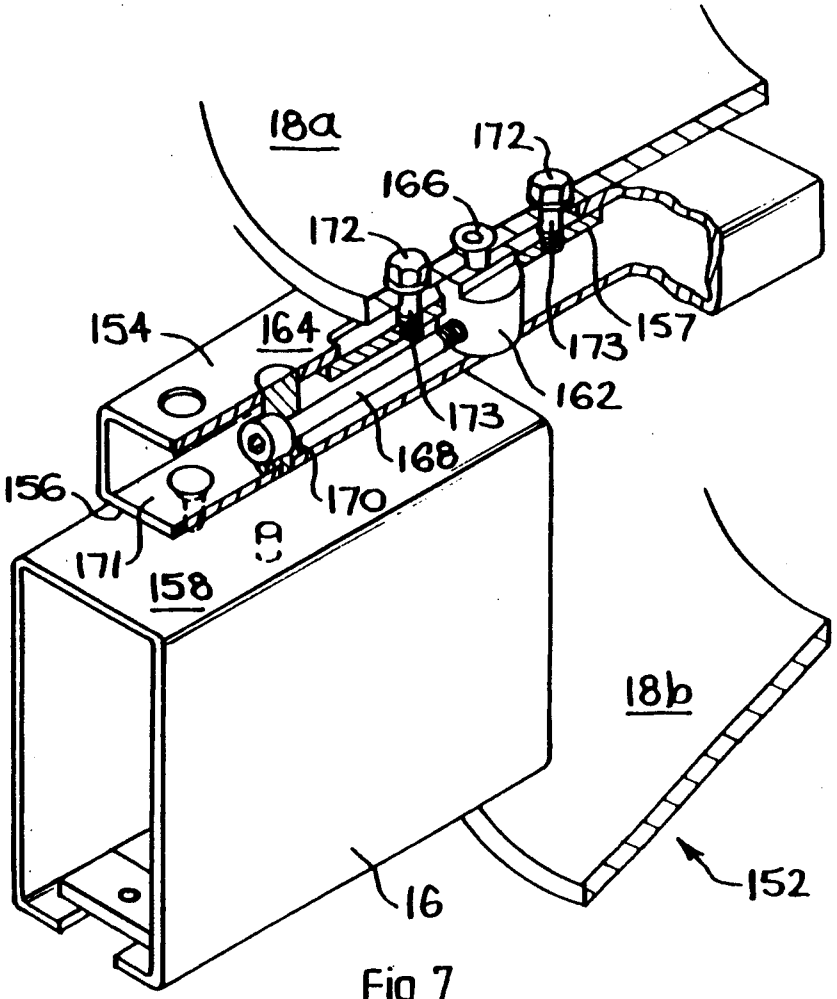
Figure 6:
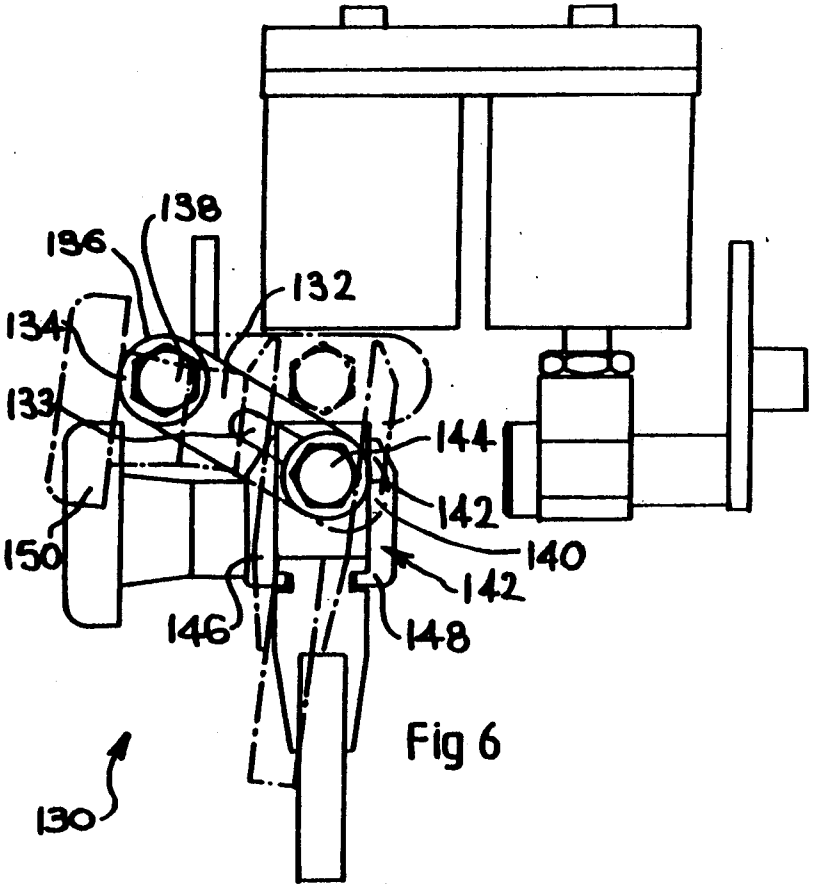
Figures 8, 9, 10:
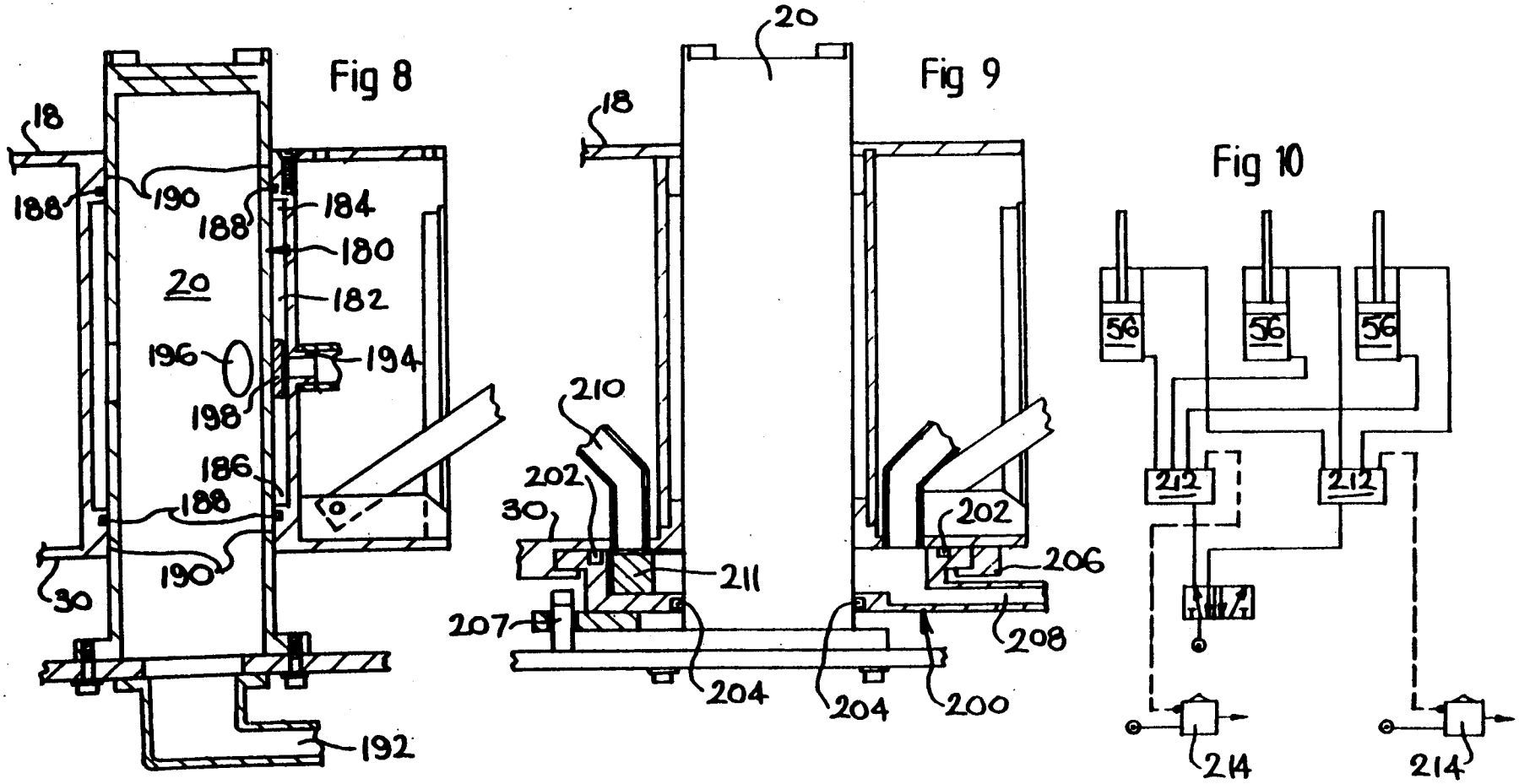
Figure 11:
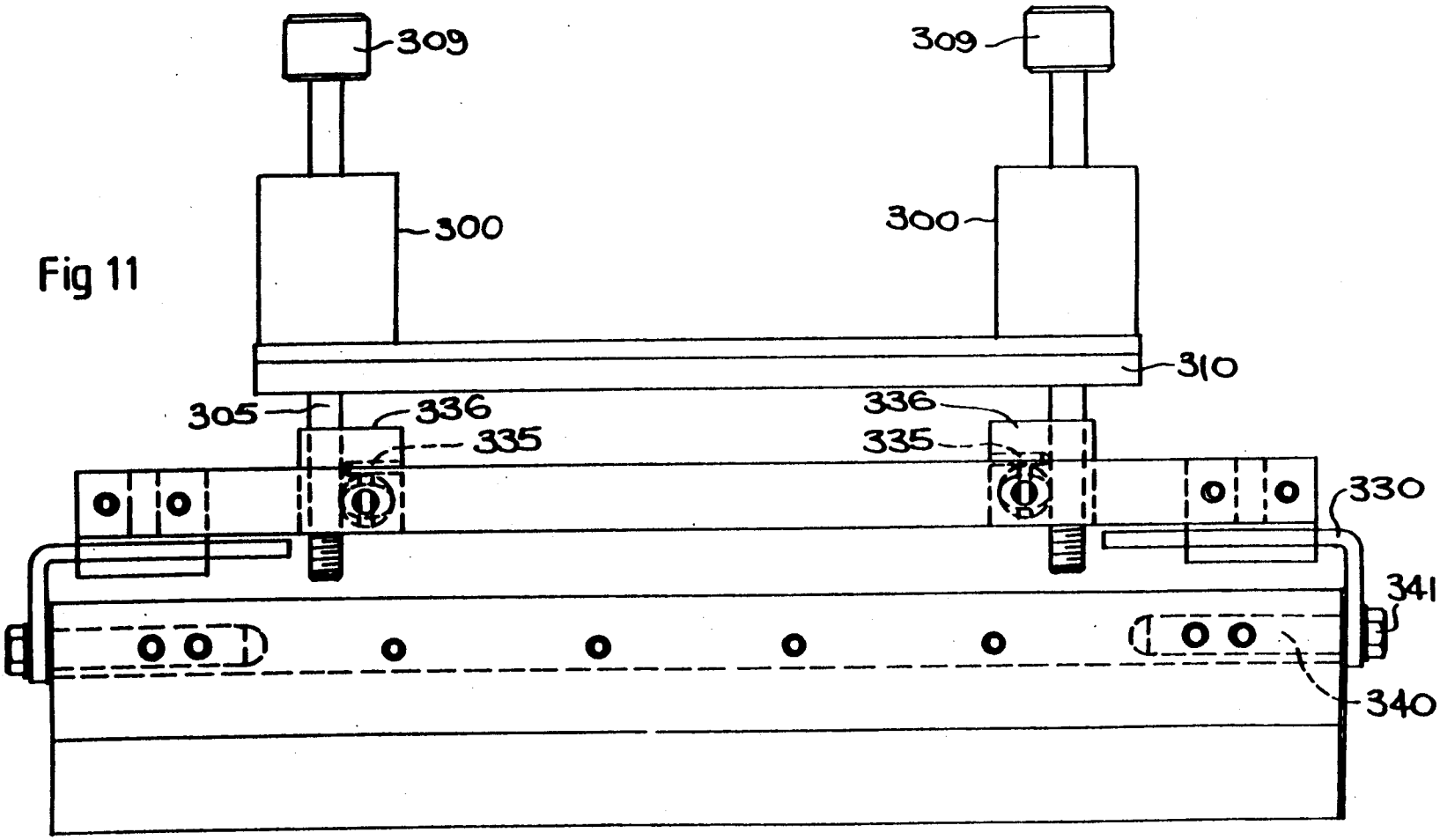
Figure 12:
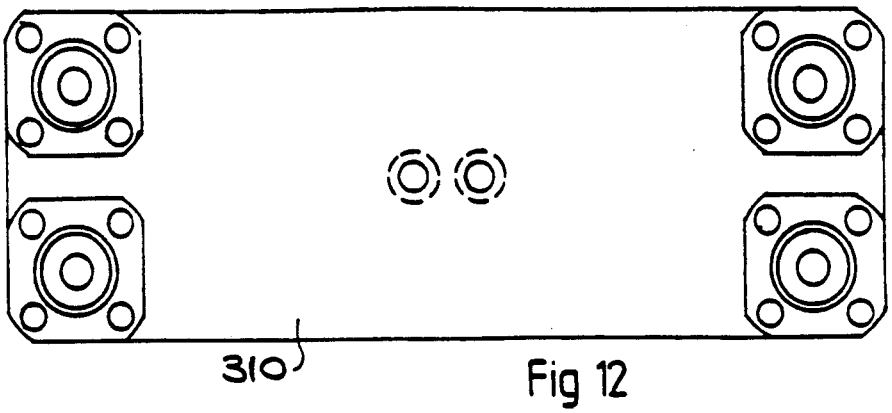
Figure 13:
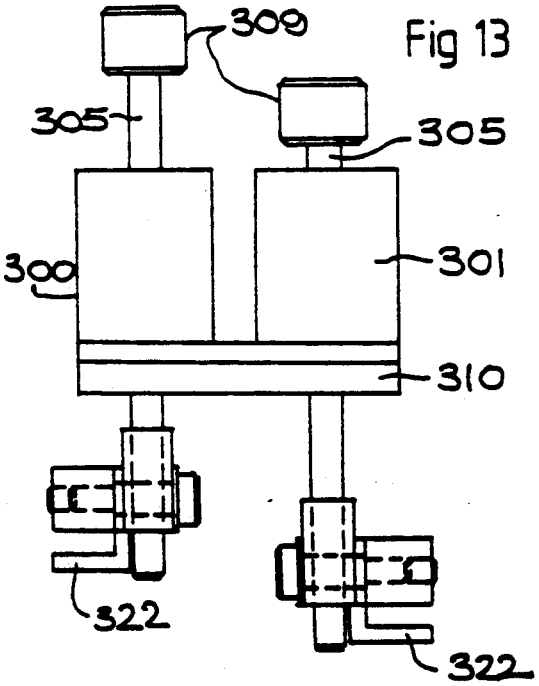
Figure 15:
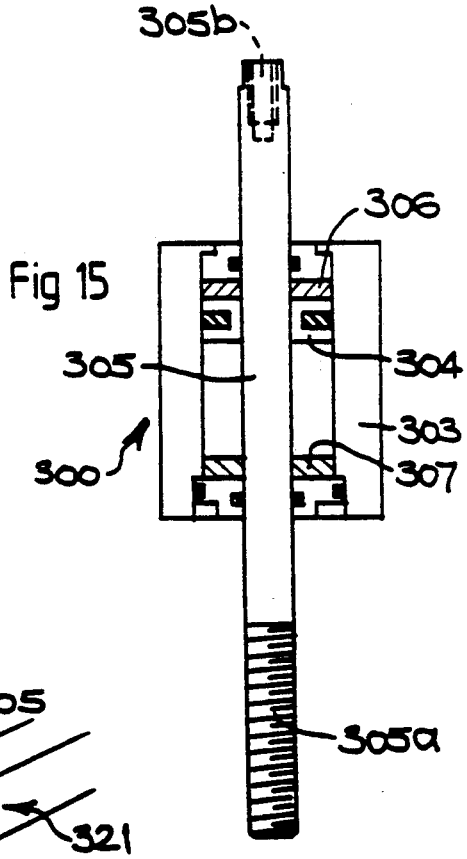
Figure 14:
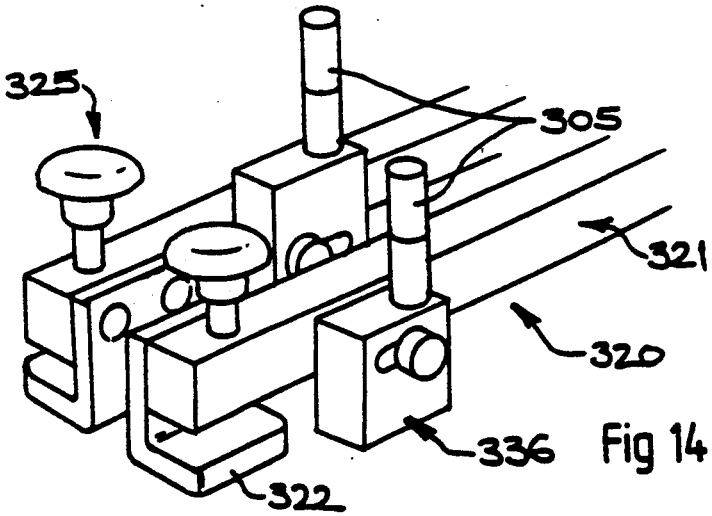
Figure 16:
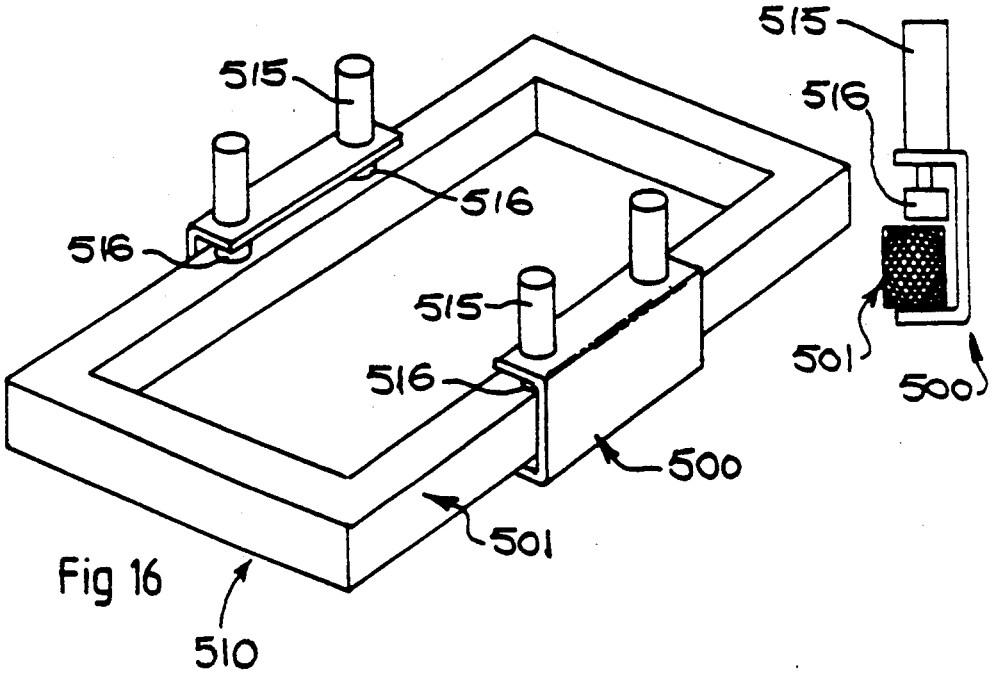
Figure 17:
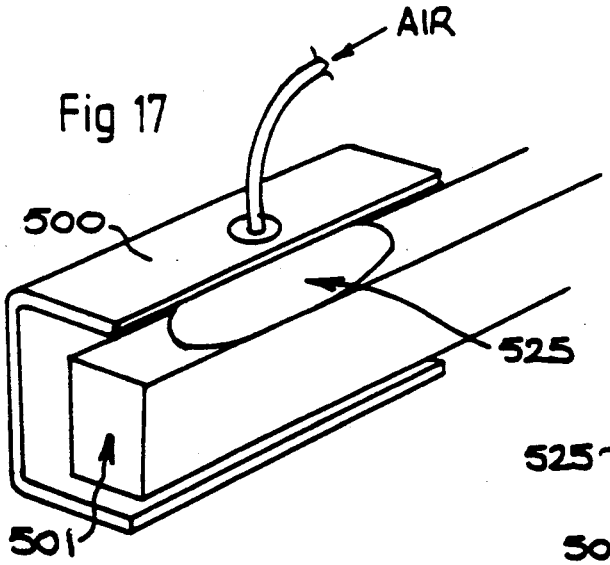
Figure 18:
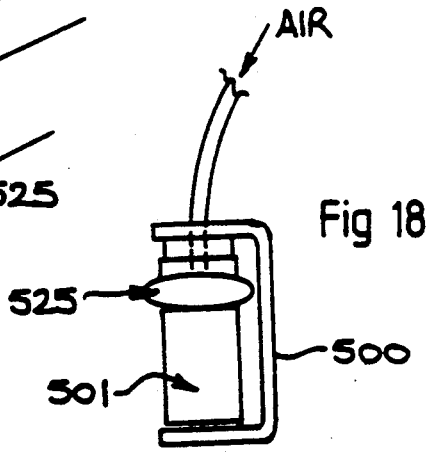
Figure 19:
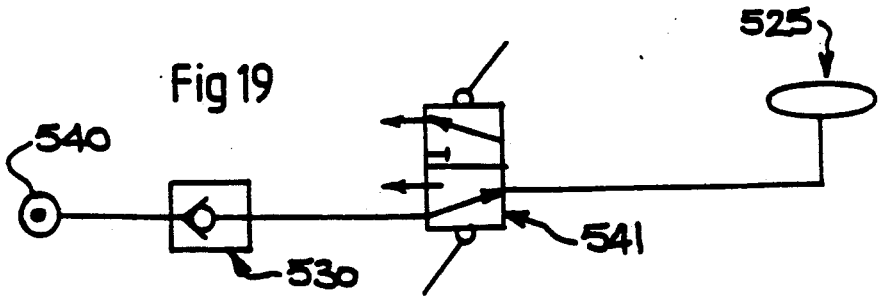
Figure 20:
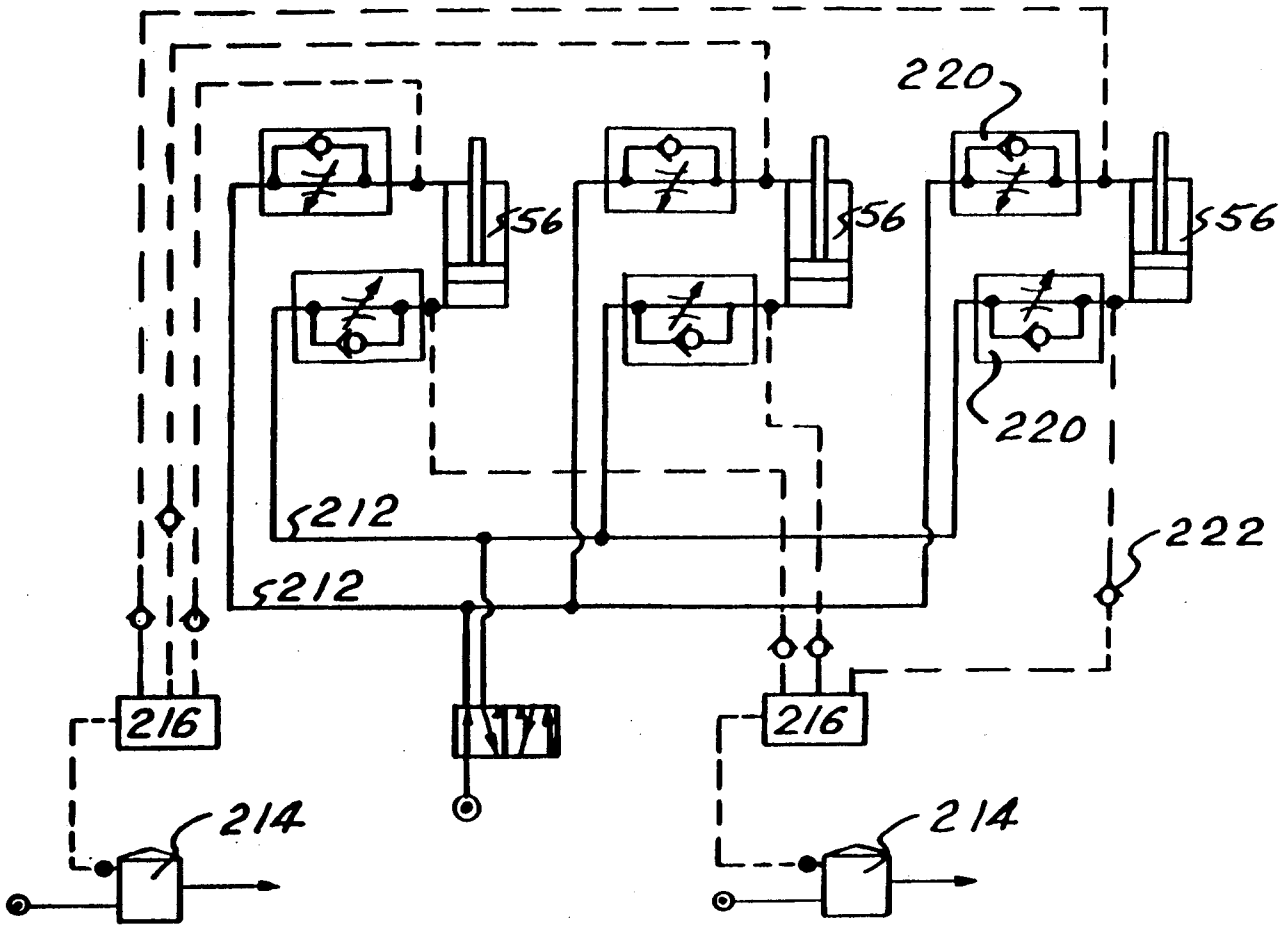

FIG. 3. is a sectional view of a detail of FIG. 2;

FIG. 4 is a plan view of a detail of the print head assembly of FIG. 2;

FIG. 5 is a plan view of another detail of the print head assembly of FIG. 2;

FIG. 6 is a view of a detail of the print head assembly of FIG. 2;

FIG. 7 is a perspective view of a levelling device for the screen printing machine of FIG. 1;

FIG. 8. is a sectional view of a detail of FIG. 1;

FIG. 9. is a sectional view of a detail of FIG. 1;

FIG. 10. is a pneumatic circuit for use in the present invention;

FIG. 11 is a side elevation of a modified form of part of the print head assembly;

FIG. 12 is a plan view of part of the assembly shown in FIG. 11;

FIG. 13 is an end elevation of the assembly shown in FIGS. 11 and 12; and FIG. 14 is a schematic partial view of the assembly shown in FIGS. 11 to 13;

FIG. 15 is a detail of a pneumatic cylinder assembly used in the assembly of FIGS. 11 to 14;

FIG. 16 is a schematic view of a prior art arrangement for mounting a screen to the apparatus;

FIG. 17 is a schematic view of a mounting arrangement according to one aspect of the invention;

FIG. 18 is an end view of the arrangement shown in FIG. 17;

FIG. 19 is a schematic circuit of a valve arrangement for the devices shown in FIGS. 17 and 18;

FIG. 20 is an alternative pneumatic circuit to that shown in FIG. 10.

Figures 21, 22:
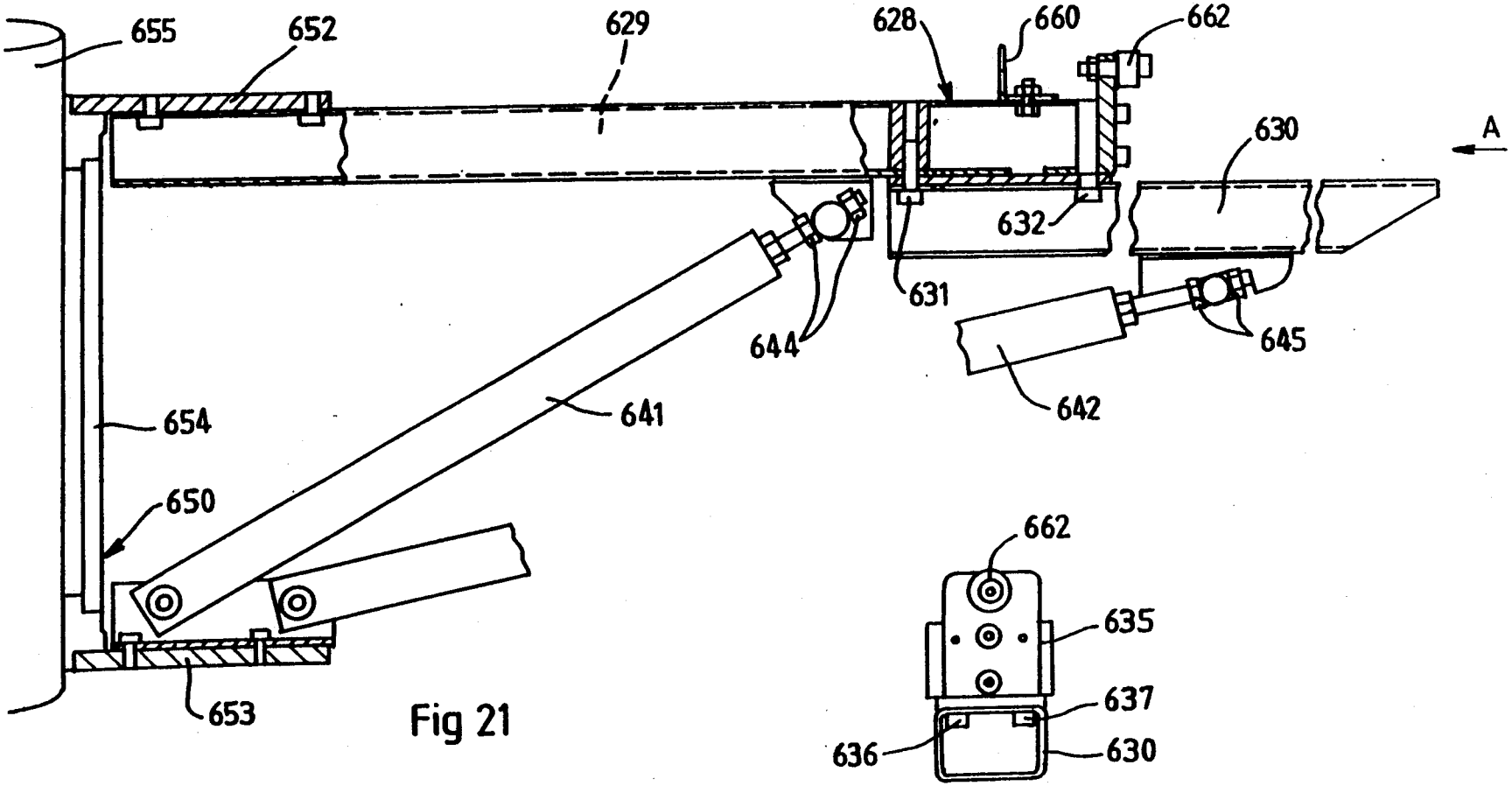

FIG. 21 is a schematic side elevation of a modified form of frame of a screen printing machine according to the present invention;

FIG. 22 is an end elevation in the direction of arrow in FIG. 21; and

Figure 23:
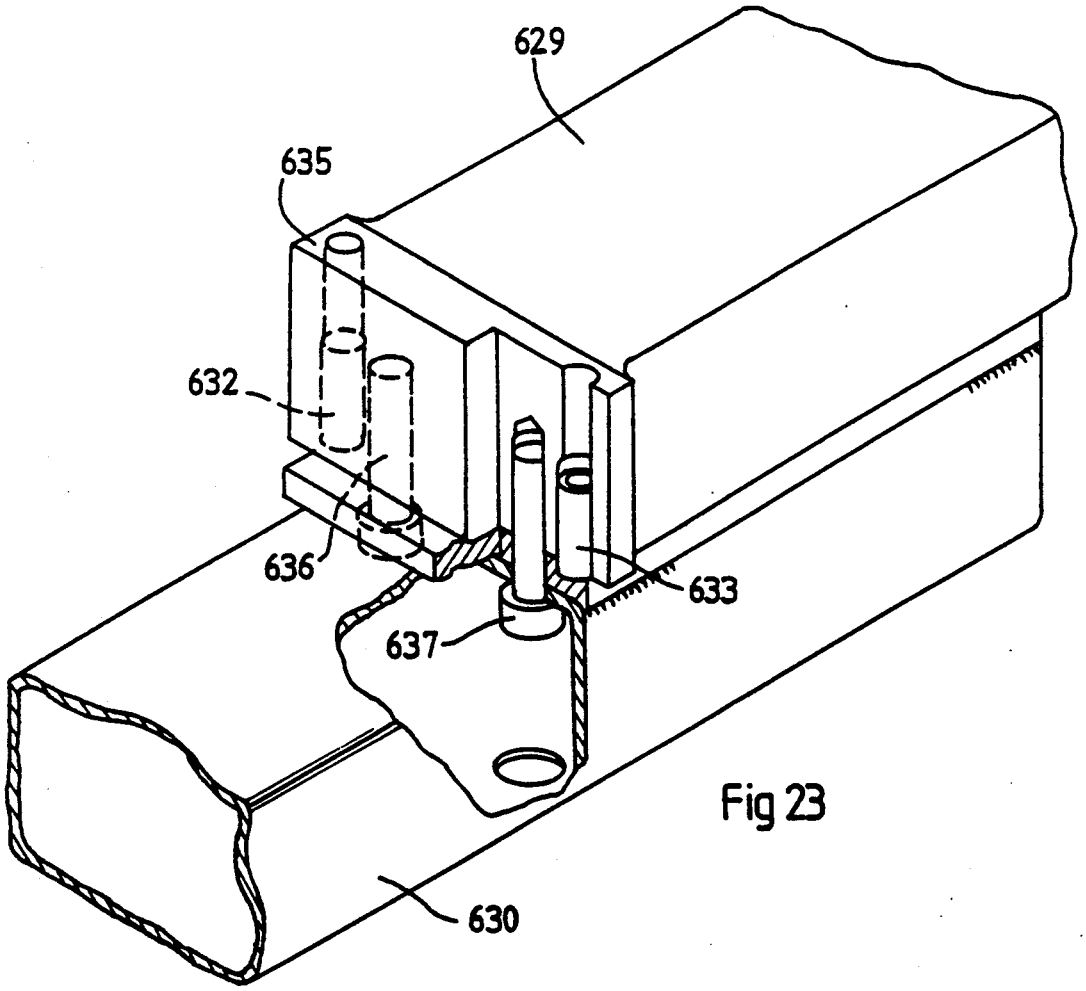

FIG. 23 is a more detailed partial perspective view showing a detail of part of the adjustment mechanism of the machine as shown in FIGS. 21 and 22.

The screen printing machine 10 illustrated in FIG. 1 includes a fixed frame 12 and a rotatable frame 14. Fixed frame 12 has multiple arms 16 that project radially from a central disk 18 which is secured to an upstanding post 20. At their outer ends, arms 16 may be supported on rectangular frame stands 22 which may be braced from a fixed angle-section ring 24 by respective radial struts 25.

The movable frame 14 likewise comprises of multiple radially projecting arms 28 fixed to a second disk 30 which forms part of a structure rotatable on post 20. Arms 28 extend in cantilever fashion and may be braced by respective uprights (not shown) and adjustable diagonal struts 26 to underlying plates 32 which form a further part of the rotatable structure and are themselves rigidified by an inner angle-section ring 34.

Post 20 is supported on a broad pedestal box 36 that itself rests upon spaced elongate stabilising feet 38. In a complete installation, arms 16 carry respective print heads 55 and the cantilever arms 28 support platens for the screens.

Box pedestal 36 houses a rotary indexing mechanism for rotating moving frame 14 about post 20. Arms 28 are equiangularly spaced by an angle equal to the angular spacing of arms 16. It will be seen that two of the arms 12 are missing and it is in this gap that the material or substrate to be printed is positioned on the printing screens on the cantilever arms 28 and retrieved therefrom after having executed a complete circuit of the carousel. Each screen must stop at each station defined by the arms 16. Means, not detailed herein, is of course provided for accurately locating and maintaining each indexed position.

Referring to FIG. 2 of the drawings, the print head assembly 40 comprises a mounting frame 42 which is operatively fixed to the arm 16 by a fixing frame 43 which will be hereinafter described. The arm 16 is an elongate tube of rectangular cross-section thereby enabling the ducting of pneumatic, electronic and other circuitry. The mounting frame 42 is similarly constructed, for example as a hollow elongate box-like cross-section, thereby facilitating the ducting of delivery lines for the print head 55 mounted on the carriage 50. Three plates 44, 46 and 48 depend from the mounting frame 42. A carriage 50 is mounted for reciprocating movement on guide members 52 and 54, the carriage 50 being adapted to carry a print head 55 thereon.

The carriage 50 is driven by a piston/cylinder assembly 56 comprising a cylinder 57 which is fixedly mounted to the mounting frame 42 between the plates 46 and 48 and includes a piston rod 58. The guide members 52 and 54 are respectively mounted between the plates 44 and 46 and plates 46 and 48 to provide additional support for the assembly during the reciprocating movement of the piston/cylinder assembly 56 and the carriage 50.

A stroke adjustment system, generally indicated by 59, comprises the guide members 52 and 54, each in the form of a rod-like member, and an actuation member 60, or trip rod, which is slidably mounted in holes 62 and 64 in the plates 44 and 46 so that its longitudinal axis is generally parallel to the direction of travel of the carriage 50. A pair of abutment blocks 66 and 68 are carried on one of the guide members 52 and the actuation member 60, these abutment blocks 66 and 68 being slidable along the guide member 52 and the actuation member 60 so that the abutment blocks 66 and 68 can be located in different positions therealong and be locked in those positions. These abutment blocks 66 and 68 are arranged to be engaged by a coupling plate 70 of the carriage 50 during its stroke. Each abutment block 66 and 68 includes a main body adapted to be slidably received on the guide member 52 and the actuation member 60 and has provided therein a threaded hole with its axis at right angles to the actuation member 60 for receiving a threaded locking screw 72 for releasably fixing the abutment block 66, 68 to the actuation member 60. The actuation member 60 is mounted so that when the abutment block 66 or 68 is engaged by the coupling plate 70 of the carriage 50 the actuation member 60 can move slightly one way or the other so that it can trigger control valves (not shown) for the piston/cylinder assembly via control means 74. Rubber dampers may be provided on the coupling plate 70 to cushion the limited axial movement of the guide track when the carriage engages an abutment block 66 or 68.

The control means 74 comprises an actuating element 76 on/or operatively connected to the actuation member 60 this actuating element 76 being adapted to engage a control switch 78 which in turn is operatively connected to control valves (not shown) for the piston/cylinder assembly 56.

The actuating element 76 is defined by a shoulder on the actuation member 60 arranged to trigger the switch 78. In another embodiment the actuating element is a triggering member which is secured to the actuation member 60.

It will be appreciated that in operation when the carriage 50 is moving in one direction and engages an abutment block 66 or 68 this causes the triggering of the switch 78 to thereby control the valves of the piston/cylinder assembly 56 to change the direction of reciprocation thereof.

A fixing frame 43 is adapted to releasably fix the mounting frame 42 to the fixed arm 16. The fixing frame 43 comprises two elongate generally U-shaped channels 79 fitted to the mounting frame 42 by fixing an inside face of the upright section of the channel 80 of the channel 43 onto the top face 42*a* of the mounting frame 42 which is adapted to receive fixing means such as, for example, bolts. The two channels 79 are then clamped together thereby fixing the print head assembly 40 to the arm 16, by way of, for example, a clamping arrangement 81, as shown in FIG. 3, which comprises a pair of connecting plates 81*a* adapted to fit over the inside face 80 of each channel 79 and fixing means such as bolts 81*b* which pass through the connecting plates thereby releasably fixing each channel 79 to the other. The print head assembly 55, by releasing the clamping arrangement 81, may be re-positioned longitudinally along the arm 16. Consequently, the print head assembly 55 can be fitted to any screen printing machine as a replacement part.

Also provided in the side face of one half of the cover 79 is an elongate slot (not shown) to facilitate longitudinal movement of the locking screws 72 for use in adjusting the stroke length of the carriage 50.

The cover 79 also serves to enclose the mounting frame 42, the piston/cylinder assembly 56 and the stroke adjustment system 59.

An air manifold, generally indicated by 82, is mounted underneath the carriage 50, the air manifold comprising two generally rectangular, substantially flat plates 84 and 86, each plate, as more clearly shown in FIGS. 4 and 5, being adapted to be mounted to the carriage 50 by way of, for example, bolts through fixing holes 88. The uppermost plate 84 has two grooves 90 and 92 machined in one face 94 so that when the respective faces of the plates 84 and 86 are superimposed and sealingly fixed to each other by way of, for example, screws through fixing holes 102, the grooves 90 and 92 provide sealed ducts within the air manifold. A pair of pneumatic cylinders 104, 106 are mounted to the underside of each end of the air manifold 82 by way of, for example, bolts through fixing holes 112. The internal ducting provided by the sealed grooves 90 and 92 within the air manifold provides a simple and compact method of providing air to the pneumatic cylinders 104, 106, 108 and 110. Other pneumatic components could of course be mounted in a like manner.

Referring again to FIG. 2 of the drawings, a height adjustment mechanism, generally indicated by 114, is provided to enable the vertical position of the flood bar 116 and the squeegee bar 118 to be varied in relation to the print head 55. The free end portion of the piston rod of each of the pneumatic cylinders 104, 106 is adapted to receive at 120 a threaded fixing bolt 122 which passes through a substantially vertical elongate slot 124 in a generally upright arm 126. The flood bar 116 and the squeegee bar 118 are mounted to support members 128 by way of a support clamp 130 which will be hereinafter described. Each support member 128 has an upright arm 126 mounted at each end.

The vertical position of the flood bar 116 or the squeegee bar 118 may be varied by releasing the fixing bolts 122, thereby enabling the support members 128 to be moved upwardly or downwardly. When the desired vertical position for the flood bar 116 or the squeegee bar 118 is obtained, the respective fixing bolts 122 are tightened thereby fixing the flood bar 116 or the squeegee bar 118 to the piston rod of the pneumatic cylinders 104, 106.

Instead of orienting the flood bar 116 and the squeegee bar 118 substantially at right angles to the platen, an angular adjustment mechanism, generally referred to as 130 in FIG. 6, is fitted to the support member 128 whereby the angle of the bars 116 and 118, relative to the plane of the platen may be varied. This angular adjustment mechanism 130 also enables the flood bar 116 and the squeegee bar 118 to be moved closer to each other. The angle adjustment mechanism 130 comprises an angle adjustment link 132 which is pivotally connected at a first end portion 134 to an end face 136 of the support member 128 which carries the flood bar 116 or squeegee 118. The end face 136 of the support member 128 is adapted to receive a threaded bolt 138 which releasably fixes the angle adjustment link 132 to the support member 128. The angle adjustment link 132 has an elongate slot 133 at a second end portion 140 whereby the adjustment link 132 is pivotally and slidably connected to a support clamp 142 adapted to receive a threaded bolt 144 which releasably fixes the angle adjustment link 132 to the support clamp 142. Further, the clamp 142 comprises a pair of opposing clamping jaws 146 and 148. Jaw 148 is fixed and jaw 146 can pivot on the shank of bolt 144 assisted by a resilient bias. The jaws 146, 148 are adapted to receive a locking screw 150 whereby the jaws 146, 148 may be opened and closed to releasably mount a flood bar 116 or squeegee bar 118. In operation the angle of the relevant bar 116, 118 may be altered by releasing the threaded bolt 138 and/or the threaded bolt 144, moving the bar 116, 118 into the desired orientation whereupon bolt 138 and/or 144 is again tightened.

The clamp 142 is operated by releasing the locking screw 150 by a sufficient linear distance to enable jaw 146 to open, relative to jaw 148, with the assistance of a spring bias, sufficiently wide to enable the flood bar 116 or squeegee bar 118 to be removed from the jaws 146, 148. When it is desired to fit replacement bars the reverse of this same procedure is required.

In a conventional screen printing machine the top disc 18 may comprise an upper top disc 18*a* and a lower top disc 18*b*. The arm 16 is fixedly mounted therebetween so that the orientation of the arm 16 cannot be varied in a substantially vertical plane. The screen printing machine of the present invention, however, provides a level adjustment mechanism, generally indicated by 152 in FIG. 7, whereby the angular orientation of the fixed arms 16 may be varied in a substantially vertical plane in relation to the movable arms 28 thereby ensuring that the arms 16 are parallel to the arms 28. Consequently the rectangular frame stands 22 are no longer required. The level adjustment mechanism 152 comprises a level adjustment link 154 which is a substantially rectangular tube mounted at a bottom face of a first end portion 156 to a top face of an inner end portion 158 of the top of the arm 16 by way of, for example, bolts or welding. The other end portion 157 of the level adjustment link 154 is slidably mounted to the underside of upper top disc 18*a*. The level adjustment link 154 is adapted to slidably receive a body 162 whereby the body 162 passes through the top face 164 of the adjustment link 154 and is fixed to the upper top disc 18*a* by a counter-sunk screw 166. The body 162 is also adapted to receive a threaded adjustment bolt 168 which passes through an end plate 170 which is fixed in the hollow region 171 formed by the level adjustment link 154, the end plate 170 is welded to the inside perimeter of the level adjustment link 154. The adjustment bolt 168 has its longitudinal axis substantially parallel to the axis of the arm 16.

Fixing bolts 172 and corresponding elongate longitudinal slots 173 are provided in the top face of the other end portion 157 of the level adjustment link 154 to releasably fix the level adjustment link 154 to the upper top disc 18*a* whereby on releasing the fixing bolts 172 and rotating the adjustment bolt 168, the upper face 158 of the fixed arm 16 is thereby moved longitudinally in relation to the upper top disc 18*a* causing the free end of the arm 16 to move upwardly or downwardly. The bottom inner end portion of the arm 16 is rigidly fixed to the lower top disc 18*b*. When the desired orientation is obtained for the arm 16 the fixing bolts 172 are tightened to fix the level adjustment link 154 to the top disc 18.

Referring to FIG. 8, the central column 20 acts as a vacuum chamber whereby a rotary manifold 180 is arranged around the central column 20 of the screen printing machine 10 for ducting vacuum to the platens so that articles to be printed are firmly attached to the platens. The rotary manifold 180 comprises an upright elongate annular cylinder 182 surrounding the central column 20 of the screen printing machine 10, the open ends 184 and 186 of the annular cylinder 182 being enclosed by the top disc 18 and a bottom disc 30 and sealed by annular seals 188 retained by a seal retainer 190. The top disc 18 and the bottom disc 30 rotate on the stationary central column 20.

In operation the rotary manifold 180 rotates relative to the central column 20 so that the vacuum supplied directly to the central column 20 through an inlet 192 duct from a vacuum pump (not shown) is distributed to outlet ports 194 via apertures 196 in the wall of the central column 20, thereby supplying vacuum to each of the movable arms 28 on which the platens are mounted. As the movable arms 28 of the screen printing machine 10 rotate, a vacuum will be supplied to the platens, however when the movable arms 28 are to be unloaded the vacuum will be shut off by way of a plug 198 which is fitted to inside wall of the central column 20.

In an alternative arrangement an annular collar 200 surrounds the central column 20 of the screen printing machine 10. Referring to FIG. 9, the annular collar 200 is mounted underneath the bottom disc 30 or, alternatively, on the top disc 18, both discs 18 and 30 rotate on the central column 20. The annular collar 200 is sealingly engaged to the relevant disc 18, 30 by annular seals 202 and 204, seal 202 being retained by a seal retainer 206.

In operation, the annular collar 200 is fixed to the central column 20, the annular collar 200 being adapted to receive an annular seal 202 and a vacuum is supplied from a vacuum pump (not shown) through an inlet duct 208 is supplied directly to each of the movable arms 28 via outlet ports 210. As the movable arms 28 of the screen printing machine 10 rotate, a vacuum will be supplied to the platens, however when the movable arms 28 are to be unloaded the vacuum will be shut off by way of a plug 211 which is fitted to the inside wall of the annular collar 200.

Referring to FIG. 10 a pneumatic circuit is provided for the screen printing machine 10 whereby the outlet port of each piston/cylinder assembly 56 on the screen printing machine for reciprocating the print heads 55 is connected to a manifold 212. The manifold 212 is connected in series to a NOT gate 214 whereby when any one or more of the piston/cylinder assemblies is in its outstroke mode a positive air pressure will be received by the NOT gate 214 which will, in combination with the pilot air supply, which is also supplied to the NOT gate 214, will prevent a subsequent process operation being completed. The same circuit is duplicated for connection to the inlet port of each piston/cylinder assembly 56. The described circuit eliminates the requirement to fit a valve to every piston/cylinder assembly 56 thereby simplifying the machine and reducing manufacturing costs.

An alternative arrangement is shown in FIG. 20. In this arrangement, flow controllers 220 are provided and the NOT gates 214 are connected at a point between the cylinder ports and flow controllers 220. The sensing lines pass through a control manifold 216 and then on to the NOT gate 214. Check valves 222 may be provided in order to prevent return flow along the line. The flow controllers 220 control the flow of air from the cylinder and thereby control the movement of the print head.

By providing a control manifold as shown it is possible to sense the air pressure in one or more of the cylinders. As such, before the NOT gate is triggered the pressure in the cylinder must approach very close or be zero. Thus a single valve is only required to control a number of cylinders and ensure completion of stroke under normal operation. Furthermore, it is not necessary to provide complicated limit switches or sensors to determine the end of the sequence.

Referring to FIGS. 11 to 15, another form of height adjustment means is shown. In this particular arrangement, the control means for raising and lowering the squeegee and flood bar comprises a plurality of pneumatically operable cylinder assemblies 300 and 301. Two cylinder assemblies 300 control the squeegee and two 301 control the flood bar. Each comprises a cylinder 303 having a piston 304 therein and a piston rod 305 operatively interconnecting the squeegee and/or flood bar with the piston. The piston rod 305 is rotatable and operatively connected to the squeegee and/or flood bar so that rotation thereof causes an actual adjustment between the piston rod and squeegee and/or flood bar. The end of the piston rod 305*a* operatively connected to the squeegee and/or flood bar includes a threaded section arranged so that upon rotation of the two parts relative to one another an adjustment in the direction of the axis of the piston rod is made.

The piston rod 305 is adapted to extend through the cylinder having portions thereof projecting from each end. One end 305 is operatively connected to the squeegee and/or flood bar and other end 305*b* has an actuator such as, for example, a manually operable knob 309 thereon for rotating the piston rod. The piston rod 305 is operatively connected to the squeegee and/or flood bar via a support bracket 320 to which the squeegee and/or flood bar is mounted. The support bracket may include an elongated laterally extending arm 321 having support flanges 322 thereon adapted to receive a mounting element 330 which can form part of the squeegee and/or flood bar. A clamping member 325 such as a screw threaded rod may be adapted to releasably hold the mounting element in position on the support flange. Means is also provided for locking the piston rod so as to inhibit rotation thereof. Such locking means is in the form of a pin 335 which is engageable with the threaded section of the screw threaded portion of the piston rod. The pin 335 is mounted in a block 336 on arm 321. Consequently the piston is disposed within a block mounted to the arm the block having a threaded hole for receiving the threaded portion of the piston rod. The cylinder assemblies are mounted to a manifold plate 310 which may be of the type described earlier.

The squeegee and/or flood bar may also be adapted for pivotable movement relative to its support so that it can be inclined at an angle relative to the frame. To this end, each of the mounting elements 330 may include a pivot pin 340 about which the squeegee and/or flood bar can pivot. The pivot pin 340 may further include means 341 for tightening and retaining the squeegee and/or flood bar in a selected position.

Suitable thrust bearing 306 and 307 are provided at each end of the cylinder for providing support for the piston and piston rod assembly.

FIGS. 16 to 19 relate to means for mounting the screen relative to the frame of the machine. As shown in FIG. 16, one means provided comprises a pair of holding channels 500 for receiving respective side wall sections 501 of the screen 510. Pneumatically operated cylinder assemblies 515 each having a clamping foot 516 connected thereto are provided which can be brought into abutment against the screen so as to retain it with the holding channel.

As shown in FIGS. 17 to 19 according to the present invention the screen holding means includes an inflatable envelope or bag 525 which is adapted to be disposed against the screen and the holding channel so that when it is inflated, it assists in inhibiting removal of the screen from the channel. In order to ensure that there is no pressure loss during operation, as shown in FIG. 19 the incoming air supply has a check valve 530 provided which inhibits the return of air from the inflatable envelope 525 to the source 540. A control valve 541 is provided.

FIGS. 21 to 23 show a modified form of assembly for the movable arms of the frame of the machine. In the modified form each movable arm 628 comprises an inner arm section 629 and an outer arm section 630 operatively interconnected so that their longitudinal axes are generally parallel. The end of the inner arm section 629 is connected to a central part 650. The central part 650 of the movable or rotatable frame comprises upper and lower discs 652 and 653 interconnected by a rigid tube 654. Tube 654 is mounted for rotation about post 655 through suitable bearings. As shown the inner arm section 629 is connected to the upper disc 652 and extends therefrom in cantilevered fashion.

The inner and outer arm section 629 and 630 are connected together by a series of adjustment screws 631, 632, 633. As shown in FIG. 23 two screws 632 and 633 are laterally spaced and disposed in an end plate 635. Each screw 632 and 633 has a fixing screw 636 and 637 associated therewith. By appropriate manipulation of the screws the platen can be tilted about an axis or axes generally parallel to the axes of the arm sections.

As shown in FIG. 21 the axis section 629 and 630 are supported by primary and secondary adjustable support struts 641 and 642. Each of the struts has one end connected to the central part 650 in the region of the lower disc 653.

The other end of each strut is connected to the arm at points spaced along the length thereof. As shown the primary strut 641 is connected in the region of the junction of the inner and outer sections and the secondary strut 642 in a region towards the free end of the outer arm section. Adjusting nuts 644, and 645 enable the length of the struts to be changed. By this arrangement the orientation of the axis relative to the central pad can be changed so that the platens can be disposed in a selected orientation.

As can best be seen in FIG. 21 the primary strut 641, the central part 650 and the section of the inner arm section 629 between the central part 650 and where the strut 641 connects to the inner arm section 629 form a triangle with the strut 641 defining the hypotenuse. Similarly the secondary strut 642, the central part 650 and the section of the outer arm section 630 and the inner arm section between the central part 650 and where strut 642 connects to the outer arm section 630 form another triangle with the strut 642 defining the hypotenuse.

A stiffening ring 660 is connected between the inner arm sections of the frame and a registration roller 662 is attached to the place 635.

The embodiments have been described by way of example only and modifications are possible within the scope of the invention.

I claim:

1. A print head assembly for use with a screen printing machine of the type including a fixed frame having a plurality of arms and a movable frame carrying a plurality of platens, the movable frame being mounted for rotation relative to the fixed frame, the print head assembly comprising:

a) a mounting frame which in use is operatively connected to an arm of the fixed frame;

b) a carriage operatively connected to the mounting frame and arranged for reciprocating movement relative thereto;

c) a piston/cylinder assembly for causing the reciprocating movement of the carriage, the assembly including a cylinder having opposed ends with a piston therein;

d) first, second and third support members extending from the mounting frame and in spaced relation relative to one another, said third support member being disposed between said first and second support members;

e) guide means operatively connected to said support members in spaced relation from the mounting frame such that together they form a rigid structure;

f) said carriage including at least two bearing sections slidably received on said guide means, said bearing section being spaced apart with one being disposed between the first and third support members and the other between the second and third support members, and said carriage further including a coupling section connecting the piston to the carriage;

g) said cylinder being supported between one of said first or second support members and said third support member.

2. A print head assembly according to claim 1 wherein said guide means comprises a pair of guide members which extend generally parallel to one another between said first and second support members.

3. A print head assembly according to claim 2 wherein said piston/cylinder assembly includes a piston rod operatively connected to the piston and extending from one end of the cylinder said coupling section being operatively connected at or towards a free end section of the piston rod.

4. A print head assembly according to claim 3 wherein said guide members comprise guide rods which are disposed one above the other in a general vertical plane.

5. A print head assembly according to claim 1 wherein said first, second and third support members respectively comprise first, second and third support plates operatively connected to and extending laterally from the mounting frame, said third support plate being intermediate said first and second support plates, and said cylinder being supported between said third support plate and one of said first or second support plates.

6. A print head assembly according to claim 1 further including a fixing frame which is adapted to be secured to an arm of the machine, said fixing frame being adapted to receive the mounting frame thereon and being releasable to allow the mounting frame to be movable along the arm.

7. A print head assembly according to claim 1 further including an adjustment system which enables adjustment of the length of the stroke of the carriage, the system comprising at least one actuation member having a longitudinal axis which extends generally parallel to the direction of travel of the carriage and a pair of abutment blocks adapted to be slidably supported on the or each elongated guide member and the actuation member so that the abutment blocks can adopt selected positions along the length thereof, the abutment blocks being disposed relative to the carriage so that they can be engaged by the carriage during its reciprocating movement, and control means associated with the actuation member responsive to engagement of the carriage with an abutment block, the arrangement being such that when the carriage engages an abutment block, the control means causes the piston/cylinder to change its reciprocating direction.

8. A print head assembly according to claim 7 wherein said actuation member is mounted for limited movement in the direction of its longitudinal axis so that upon engagement of an abutment block by the coupling plate of the carriage the actuation member is shifted slightly in the axial direction, this axial movement causing actuation of the control means and deceleration of the carriage.

9. A print head assembly according to claim 8 wherein said control means comprises a control switch operable to activate control valves for the piston/cylinder assembly, said control switch being arranged to be operable by engagement with a portion of the actuation member or a member operatively connected to the actuation member.

10. A print head assembly according to claim 1 including a squeegee and a flood bar carried on said carriage, and pneumatically operable control means for alternatively raising and lowering at least one of the squeegee and the flood bar.

11. A print head assembly according to claim 10 further including a height adjustment means provided to vary the position of at least one of the squeegee and the flood bar in relation to the print head assembly, the height adjustment means comprising a support member, extending parallel to the squeegee or flood bar, fixed to at least one generally upright member having a substantially vertical elongated slot therein, means for releasably fixing the upright member to the control means, the control means being to mount the upright member whereby a height adjusting screw, in use, releasably fixes the upright member to the control means.

12. A print head assembly according to claim 11 further including an angular adjustment means to vary the angular orientation of at least one of the squeegee and the flood bar in relation to the print head assembly, the angular adjustment means comprising an angle adjustment link pivotally connected at a first end portion to an end face of the support member and pivotally connected at a second end portion to a support clamp, the support clamp being adapted to releasably mount the support member to the angular adjustment link.

13. A print head assembly according to claim 12 wherein the support clamp comprises a pair of opposing jaws which pivot on the second end portion of the angle adjustment link and a locking screw thereby releasably mounting at least one of the squeegee and the flood bar to the support member.

14. A print head assembly according to claim 10 including a height adjustment which at least in part is comprised by part of the control means for alternately raising and lowering at least one of the squeegee and the flood, said control means comprising a plurality of pneumatically operable cylinder assemblies each comprising a cylinder having a piston therein and a piston rod operatively interconnecting at least one of the squeegee and the flood bar with the piston, the piston rod being rotatable and operatively connected to at least one of the squeegee and the flood bar so that rotation thereof causes an axial adjustment between the piston rod and at least one of the squeegee and the flood bar.

15. A print head assembly according to claim 14 wherein the piston rod is adapted to extend through the cylinder having portions thereof projecting from each end, one end being operatively connected to at least one of the squeegee, the flood bar, and a support therefor and the other end having an actuator thereon for rotating the piston rod, the piston rod being operatively connected to at least one of the squeegee and the flood bar.

* * * * *